United States Patent [19]

Baker, Jr.

[11] 4,221,314

[45] Sep. 9, 1980

[54] CARRIER FOR SKIS AND SKI POLES

[76] Inventor: Christopher L. Baker, Jr., 1960 Commonwealth Ave., #47, Brighton, Mass. 02135

[21] Appl. No.: 919,695

[22] Filed: Jun. 27, 1978

[51] Int. Cl.[2] ..... B65D 71/00

[52] U.S. Cl. ..... 224/45 S; 280/814; 24/81 SK

[58] Field of Search ..... 224/45 S, 45 T, 45 P, 224/55, 57, 58, 917, 202, 205, 207; 280/11.37 A, 11.37 K; 24/3 R, 73 SG, 81 SK, 117, 115 R, 3 M, 76, 201 HE; 70/58; 211/60 SK

[56] References Cited

U.S. PATENT DOCUMENTS

| | | | |
|---|---|---|---|
| 3,905,214 | 9/1975 | Bell | 280/11.37 A |
| 3,935,977 | 2/1976 | Bonnett | 224/45 S |
| 4,002,277 | 1/1977 | Westerholm | 280/11.37 A |
| 4,127,223 | 11/1978 | Uchin | 224/55 |

FOREIGN PATENT DOCUMENTS

| | | | |
|---|---|---|---|
| 1466972 | 12/1966 | France | 280/11.37 K |
| 208365 | 4/1940 | Switzerland | 224/45 S |

*Primary Examiner*—Kenneth W. Noland
*Attorney, Agent, or Firm*—Wenderoth, Lind & Ponack

[57] ABSTRACT

A pair of thin, hinged carriers are designed to close around and hold therein both skis and ski poles. A snap lock structure is incorporated into the structure to securely keep it closed around the skis and poles. Each carrier has a hook formed on at least one side thereof, and a flexible belt extending between the carriers is connected at each end to one of these hooks.

11 Claims, 16 Drawing Figures

CARRIER FOR SKIS AND SKI POLES

BACKGROUND OF THE INVENTION

The present invention relates to a device for holding and carrying skis.

Snow skiing, both downhill and cross-country skiing, is becoming an increasingly popular winter sport, and as is well known, skiing requires specialized equipment. Basically, it is necessary for the skier to have ski boots, skis and poles. Transporting all of this equipment, however, can become quite cumbersome, especially carrying the long skis and poles while walking around the ski site when the skier is not actually skiing.

In an effort to simplify the problems which arise when trying to carry two long skis and two long ski poles, various devices have been developed which usually somehow clamp around or wrap around the skis or poles or both so that they can be carried. The major drawback to most of these devices is what to do with the device while the skier is actually skiing. These devices are generally too big and bulky to be conveniently carried by the skier while on the slopes, and because of their size, they are usually expensive to fabricate and purchase.

SUMMARY OF THE INVENTION

In light of the necessity to produce some sort of convenient ski carrying device, it is a primary objective of the present invention to provide a ski and pole carrier which is more compact, more economical to produce, and more easily stored when not in use than the previously developed ski carriers.

It is a further objective of the present invention to provide a ski carrier which can be easily opened and closed by anyone and can be used to carry skis in a sling fashion over the skier's shoulder.

Furthermore, it is an object of the present invention to provide a ski carrier which can be left in place on the skis and poles while this equipment is being transported in a conventional automobile ski carrier.

Fundamentally, the present invention is a pair of thin, hinged carriers which are designed to close around and hold therein both the skis and the ski poles. A snap lock structure is incorporated into each carrier to securely keep it closed around the skis and poles. Each of the carriers has an attaching member on at least one side thereof, and a flexible belt is connected at each end to one of these attaching members. In this fashion, when the carriers are spaced from each other around the skis and poles a sling or handle created by the belt extends between the carriers.

BRIEF DESCRIPTION OF THE DRAWINGS

Further objectives and a better understanding of the present invention will become apparent from the following description taken in consideration with the drawings, wherein.

DETAILED DESCRIPTION OF THE INVENTION

Figure 3:
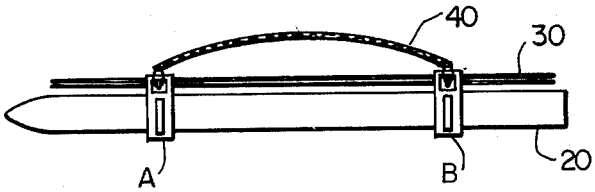
FIG. 3 is a side view of the carrier of the present invention positioned around a pair of skis and ski poles.

The carrier of the present invention is generally designed so that it may be utilized as shown in FIG. 3. Two carrier bodies A, B are clamped around a pair of skis 20 and a pair of ski poles 30. A flexible belt 40 is removably connected to the carrier bodies A, B and extends therebetween.

Figure 1A:
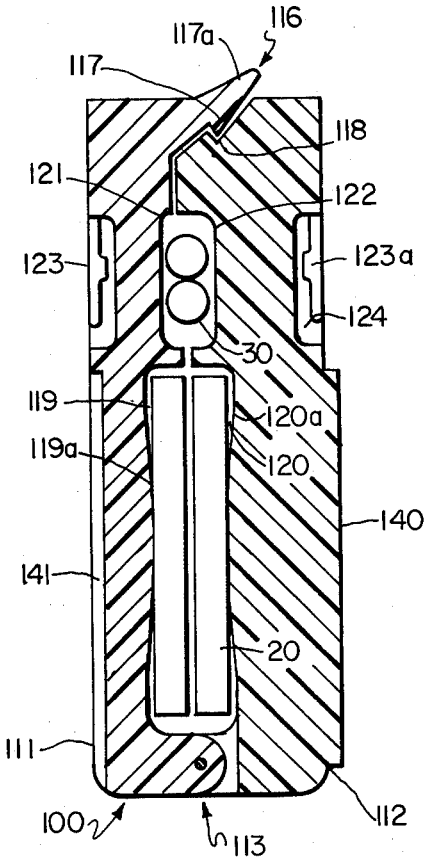
FIGS. 1*a* and 1*b* are a side view (1*b*) and a cross sectional view (1*a*) along the line 1—1 of a first embodiment of a carrier body of the invention.
Figure 1B:
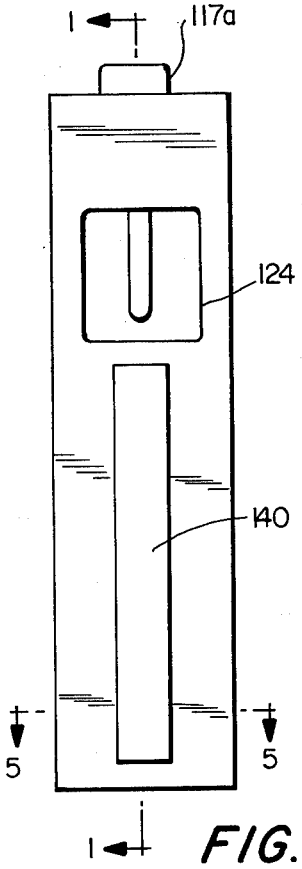

FIGS. 1*a*, 1*b* show the basic construction of the carrier bodies A, B. The carrier bodies A, B are identical and are represented by the body 100. Each body is preferably formed from a suitable synthetic material such as plastic or nylon which can be easily formed or molded and which will still retain some degree of resiliency when cold.

Figure 5A:
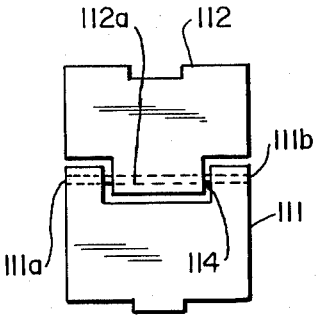
FIGS. 5*a*–5*c* are views taken along the line 5—5 of FIG. 1*b* and show possible hinge constructions for joining the side portions of a carrier body of the present invention.
Figure 5B:
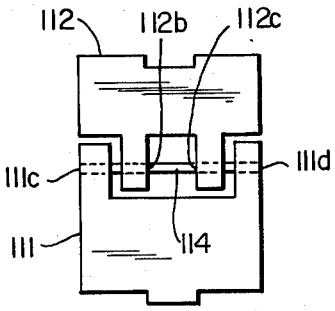
Figure 5C:
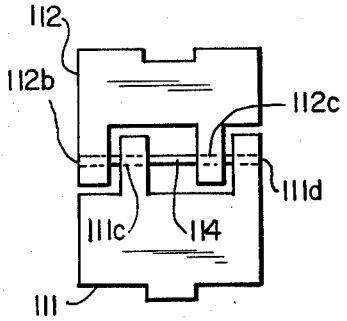

The body 100 has two side portions 111, 112 which are joined together at the bottom ends thereof by a hinge formation 113. FIGS. 5*a*–5*c* show various possible constructions of the bottom portions of sides 111, 112. The constructions enable a connecting rod 114*a* to pass through aligned holes 111*a*, 111*b* and 112*a* through the bottoms of each side portion (FIG. 5*a*) or allow two connecting rods 114*b*, 114*c* to pass through aligned holes 111*c*, 111*d* and 112*b*, 112*c* in the side portions (FIGS. 5*b* and 5*c*).

Figure 6:
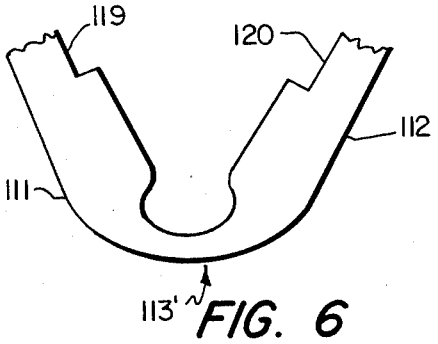
FIG. 6 shows an integral hinge connecting the side portions of a carrier body of the present invention.

FIG. 6 represents still another hinge formation which is also possible. In this instance, the two side portions 111, 112 are connected by an integrally formed hinge portion 113'. This hinge portion is designed to be molded with the side portions when they are formed. The integral hinge portion 113' is, of course, flexible to allow the side portions to be spread apart.

The top of each side portion 111, 112 is formed in such a manner as to create a snap-type lock closure 116 which will hold the side portions securely together when they are pivoted toward each other about the hinge 113. As shown in FIG. 1*a*, a protrusion 117 snaps into an indentation 118. At the top of the protrusion 117 is a thumb projection 117*a* which extends above the top surface of the carrier. When pressure is exerted against this projection 117*a*, the protrusion 117 is lifted from the indentation 118 and the two side portions are released from their locking connection.

Figure 2:
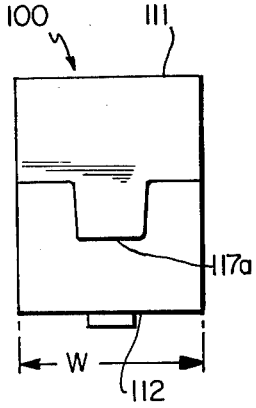
FIG. 2 is a top view of the invention.

As further shown in FIG. 2, the snap-type lock closure 116 is positioned at approximately the center of the top surface of the carrier. It is preferred that the protrusion 117 and the indentation 118 only extend partially across the width W of the carrier at the center, but it is also possible for both to extend all of the way across. By having this locking portion essentially in the center, there is less chance of the two side portions coming apart since the locking will take place in one small area rather than across the entire width.

In order to provide space to hold the skis 20, facing ski indentations 119, 120 are created in the side portions 111, 112 respectively so that the skis 20 can be held between the side portions when the side portions are pivoted toward each other and locked together. The combined width of these indentations when they are opposite each other should be no more than slightly larger than the width of the skis positioned thereinbetween so that the skis are held securely.

The indentations 119, 120 may also be modified to include slightly bowed portions 119*a*, 120*a* so that the skis 20 will be held securely in this space. Because the carrier is to be at least slightly resilient, the bowed portions will fit snugly against the skis 20 when the side portions 111, 112 are forced together. It is further possible to line the indentations with a material (not shown) which is more resilient than the carrier which will compress against the skis 20 when the side portions are brought together, and in this manner also hold the skis securely within the carrier.

Above the ski indentations 119, 120 are two ski pole indentations 121, 122 in each of the side portions 111, 112 respectively. The pole indentations accommodate two ski poles thereinbetween when the side portions are locked together. As shown in FIG. 1*a*, these pole indentations can be shaped to receive the ski poles one on top of the other or they may also be shaped to receive the ski poles horizontally side by side (not shown). With further regard to the ski indentations, it is also possible to eliminate these entirely and still have the ski indentations 119, 120. The carrier would then be used solely for carrying skis. This construction would be especially suitable for carrying water skis which require no poles.

FIGS. 1*a*, 1*b* show one embodiment of the various types of attaching members which may be formed or positioned on one or both sides of the carrier to receive the flexible belt 40. FIGS. 7 and 7*a* and FIGS. 8 and 8*a* show two additional attaching members. In FIG. 1*a*, near the top of at least one of the side portions 111, 112 is a hook-like formation 123. Two hooks 123 are shown, but both are not always necessary. The hook 123 is preferably integrally formed with the side portion, and is slightly resilient. The hook may be simply a straight, downward projection, such as shown by 123 or may have a protrusion somewhere 123*a* on the inside surface thereof, as will be explained later. The hook 123 may protrude from the edge of the side portion, or as shown in FIG. 1*b*, the side portion may be recessed (as at 124) behind the hook.

Figure 7:
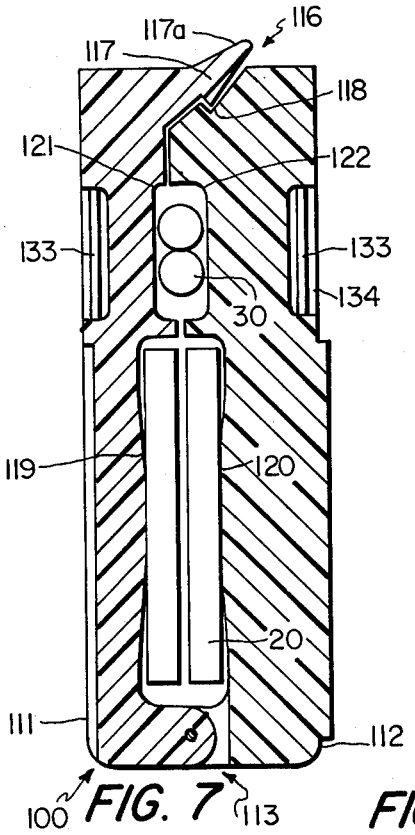
FIGS. 7 and 7*a* show a second arrangement of the attaching members for connecting the belt to the carrier body.
Figure 7A:
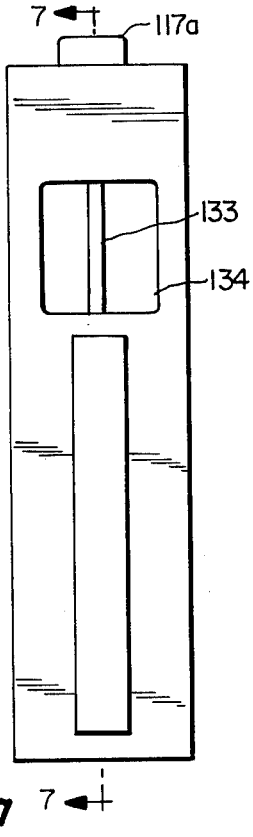

Besides the vertical hook 123, it is also possible to have a horizontal or vertical bar 133 across a portion on one or both side portions, (FIG. 7). The bar 133 may be formed integrally with the formation of the side portions or may be entered later into a recessed area 134 similar to the recessed area 124.

Figure 8:
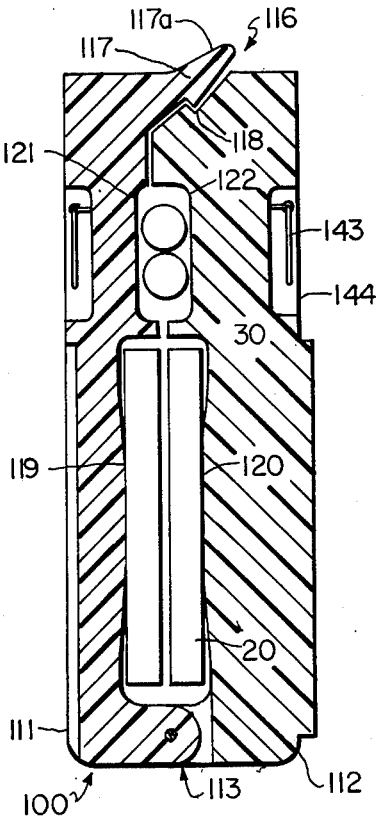
FIGS. 8 and 8*a* show a third arrangement for the attaching member for connecting the belt to the carrier body.
Figure 8A:
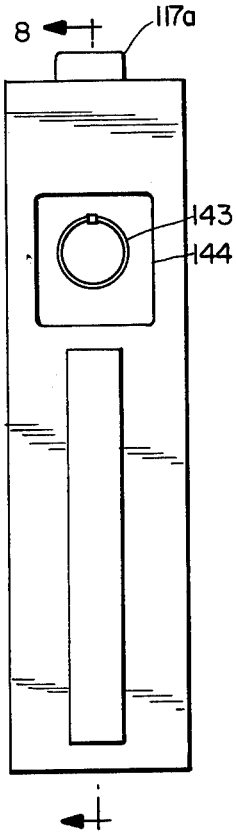

The third attaching member is shown in FIGS. 8, 8*a* and consists of a ring 143 on the outside of one or both side portions 111, 112. The ring may be either synthetic material such as plastic, metal with a plastic coating, or any other suitable material. The ring is preferably attached to the side portion so that it is free to swivel upward and downward against the side portion. Also, the ring may either be attached directly to the side of the side portion or may be mounted within a recessed area 144 so that it will at least be flat with the side surface of the side portion when not in use.

In all of these structures, the attaching members are shown on the side of the carrier body. This should not, however, be considered as limiting, since it is also possible to provide the attaching members on the end faces, rather than the sides.

Figure 4A:
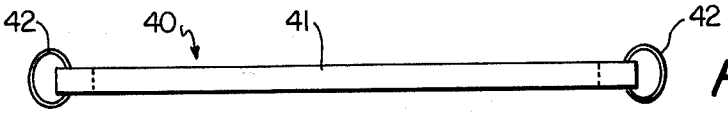
FIGS. 4*a*–4*d* are views of the various types of belts used in the present invention.
Figure 4B:
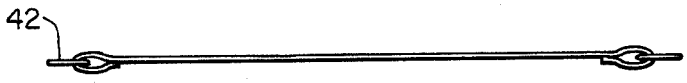

The belt 40 which extends between the two carriers A, B is preferably made of lightweight and flexible material such as cloth webbing, but any material or even a coated metal chain will suffice. The first embodiment of the belt shown in FIG. 4*a* has a material portion 41 and rings 42 at each end. These rings may be metal or plastic or any other suitable material. If they are metal, it is preferably that they be plastic-coated to prevent skin from sticking to the metal in cold weather. The length of the material portion 41 may be any length suitable for carrying the skis over the skier's shoulder, as a sling, or simply long enough to act as a handle between the two carriers. It is also possible that the length of the material can be made adjustable by any conventional means (not shown).

Figure 4C:
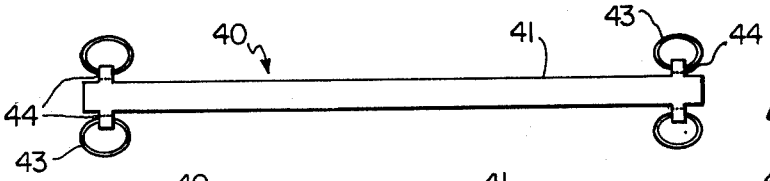

The second belt 40 embodiment shown in FIG. 4*c* shows a belt material portion 41 which has four rings 43, two at each end thereof, each ring connected to the material portion 41 by a strap 44.

When the carriers A, B each have only one hook protrusion 123, the belt 40 having only the two rings 42 may be connected between the carriers. The connection is achieved by simply inserting each ring 42 around a respective hook 123. The ring is then held between the hook and the side portion and if the hook has the projection 123*a* on the inside thereof, the hook is further restricted in its downward movement by this projection 123*a*. When the belt is lifted, the rings are urged against the top of the hook due to the downward force of gravity acting on the skis and poles in each carrier. This further insures that the rings will not fall away from the hooks. The rings may be removed by simply pulling them downward away from the hooks. Since the hooks are preferably of resilient material, the rings will easily force the protrusion 123*a* aside if force is used.

The belt embodiment shown in FIG. 4*c* is used when there are two hook portions 123 on each of the carriers, each ring 43 is slipped around one of the hooks on either side of one of the carriers, and the rings at the other end of the belt are slipped around the hooks on the other carrier. Of course, even when four hooks are provided on the carrier, the belt with only two end rings may be used, although the rings will only be slipped over one of the hooks on each carrier.

Figure 4D:
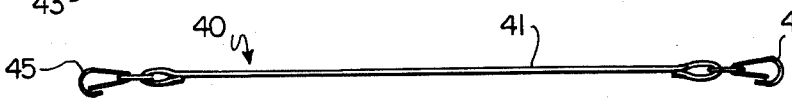

The third belt embodiment shown in FIG. 4*d* includes the flexible material portion 41, but instead of rings on the ends thereof, there are hooks 45 which will fit around either the horizontal bar 133 or the ring 143. The hooks may be simple hook structures, but preferably have a spring-biased member, e.g., a snaffle hook, which will close the open portion of the hook configuration after the hook is placed around the bar or ring. Like the belts of FIGS. 4*a* and 4*c*, the belt with hooks may either have one or two hooks on each end thereof.

To facilitate carrying both of the carriers A, B when they are not in position around the skis 20, a ridge 140 may be provided on one side portion 112 and a groove 141 may be provided on the other side portion 111. The groove 141 is substantially the same size as the ridge 140, so that the two carriers may be joined to make a single unit by sliding the ridge 140 of one carrier into the groove of the other carrier. In this manner, the two carriers may easily be kept together, thus making them easier to carry and making it less likely that one of the carriers will get lost.

Since it is an object of the present invention to provide a snow ski carrier which is more compact than those previously available, it is preferred that the over height of each carrier be between 4"-6", that the width of each side portion be 1"-3", and that the thickness of both side portions when locked together be in the range of 2"-3". The combined width of the two ski indentations 119, 120 should be between 1¼"-2" depending on the ski thicknesses, and the height should be 2¾"-3 ½". The combined width of the pole indentations 121, 122 should be approximately ½"-1" with a length of from 1¼"-1¾". Though these dimensions are given as preferable for downhill snow skis, they are not to be taken as restrictive of the size of the carriers. Different size skis, such as cross-country skis and water skis will necessarily require different dimensions to compensate for their difference in size. Primarily, however, it is desired to keep the carriers as compact as possible.

With these small dimensions, the carriers can easily be stored in the skier's pockets while skiing so that they may be readily available when the skier removes the skis. The size is also small enough so that the carriers can be left in place when the skis are placed in a typical ski rack on an automobile.

In use, the skis 20 are placed between the ski indentations 119, 120 of the two carriers A, B and the poles are placed in the pole indentations 121, 122, and then both side portions 111, 112, of each carrier are closed and locked at the snap-lock portion 116. Then, the rings 42 or 43 or hooks 45 of each belt 40 are slipped around the protrusions 123 or the bar 133 or ring 134 respectively, and the skis and poles are ready to be transported by lifting the belt and using it as a handle or, if long enough, a sling over the skier's shoulder. The skis and poles are removed from the carriers by simply pressing the thumb projection 117*a* to release the snaplock and pulling the side portions 111, 112 away from each other.

It will be apparent to those skilled in the art that additional modifications may be made to the above disclosed embodiments without departing from the scope of this invention.

What is claimed is:

1. A device for carrying skis and ski poles, said device comprising:

a pair of carrier bodies adapted to surround skis and ski poles such that said carrier bodies are spaced from each other lengthwise of the skis and ski poles, each said carrier body comprising two opposed side portions, each said side portion having an inside surface having therein a ski recess and a pole recess positioned opposite a corresponding ski recess and pole recess, respectively, in the opposed side portion, a hinge at the bottom of both said side portions rotatably connecting said side portions, and snap-lock means at the top of said side portions for locking said side portions together when said side portions are rotated toward each other about said hinge;

a plurality of attachment means on each of said carrier bodies for attaching a belt means to said carrier bodies, said attachment means comprising a plurality of recessed members, each of said carrier bodies having one of said plurality of recessed members positioned on an outside surface of each of said side portions and adjacent the top of each of said side portions; and said belt means extending between said carrier bodies for lifting and carrying said carrier bodies and skis and ski poles carried thereby, said belt means having opposite ends, each said opposite end including connecting means for connection to the plural said recessed members provided on a respective said carrier body.

2. A device as claimed in claim 1, wherein said recessed members comprise hooks.

3. A device as claimed in claim 2, wherein said belt means comprises a length of flexible material, and said connecting means comprise a plurality of circular rings on each said end of said flexible material corresponding to the number of said hooks on each respective said carrier body, each said ring being removably fitted around a respective one of said hooks.

4. A device as claimed in claim 2, wherein each said hook has a protrusion on one side thereof.

5. A device as claimed in claim 1, wherein said recessed members comprise bars.

6. A device as claimed in claim 5, wherein said belt means comprises a length of flexible material, and said connecting means comprise a plurality of hook means on each said end of said flexible material corresponding to the number of said bars on each respective said carrier body, each said hook means being removably fitted around a respective one of said bars.

7. A device as claimed in claim 1, wherein said recessed members comprise swivel rings.

8. A device as claimed in claim 7, wherein said belt means comprises a length of flexible material, and said connecting means comprise a plurality of hook means on each said end of said flexible material corresponding to the number of said swivel rings on each respective said carrier body, each said hook means being removably fitted around a respective one of said swivel rings.

9. A device as claimed in claim 1, wherein said snap-lock means is integrally formed with the top of said side portions.

10. A device as claimed in claim 1, wherein each said member is integrally formed with the respective said side portion.

11. A device as claimed in claim 1, wherein one side portion of each said carrier body has a groove therein and the other side portion of each said carrier body has a ridge thereon the same size as said groove.

* * * * *